US005484309A

United States Patent [19]

Howard et al.

[11] Patent Number: 5,484,309

[45] Date of Patent: Jan. 16, 1996

[54] ELECTRICAL RECEPTACLE ASSEMBLY WITH INTERFERENCE FITTING AND LATCHING PARTS

[75] Inventors: Carol Z. Howard, Fairfield; Ward E. Strang, Oxford, both of Conn.

[73] Assignee: Hubbell Incorporated, Orange, Conn.

[21] Appl. No.: 331,981

[22] Filed: Oct. 31, 1994

[51] Int. Cl.[6] ..... H01R 13/74

[52] U.S. Cl. ..... 439/539; 439/107

[58] Field of Search ..... 439/107, 538, 439/539, 650

[56] References Cited

U.S. PATENT DOCUMENTS

| | | | |
|---|---|---|---|
| 1,882,080 | 10/1932 | Hubbell, Jr. | 439/539 |
| 3,310,770 | 3/1967 | Ramsing | 439/107 |
| 3,688,239 | 8/1972 | Jaconette | 439/539 |
| 4,375,307 | 3/1983 | Rock | 439/107 |

*Primary Examiner*—Gary F. Paumen

*Attorney, Agent, or Firm*—Jerry M. Presson; Michael R. Swartz

[57] ABSTRACT

An electrical receptacle assembly, such as for employment in a surge suppression unit, includes a generally rectangular two-piece housing having a front cover and a back cover separate from and mateable with the front cover, a generally U-shaped mounting bridge fitted over opposite top and bottom portions of the mated front and back covers, and a plurality of pairs of securement elements respectively defined on opposite top and bottom portions of the front and back covers and on opposite portions of the mounting bridge being disposed adjacent to the opposite top and bottom portions of the front and back covers. Selected ones of the pairs of securement elements on the front and back covers are interference fittable and latchable with selected ones of the pairs of securement elements on the mounting bridge for releasably securing the mated front and back covers to the mounting bridge. Also, the securement elements on the respective front and back covers are releasably couplable with and decouplable from the securement elements of the mounting bridge without the use of tools.

20 Claims, 6 Drawing Sheets

ELECTRICAL RECEPTACLE ASSEMBLY WITH INTERFERENCE FITTING AND LATCHING PARTS

BACKGROUND OF THE INVENTION

1. Field of the Invention

The present invention generally relates to electrical equipment and, more particularly, is concerned with an electrical receptacle assembly employing interference fitting and latching parts.

2. Description of the Prior Art

Heretofore, a surge suppressor unit manufactured and marketed by Hubbell Incorporated of Orange, Conn., the assignee of the subject application, has employed an electrical receptacle assembly comprised of multiple housing and wall mounting parts which are assembled together by the use of fasteners, such as screws. Particularly, this electrical receptacle assembly has employed three separate housing parts, a generally U-shaped mounting bridge part and a plurality of holes in the parts and screw fasteners for insertion through the holes to attach the parts together.

These parts and their holes must be properly aligned with one another and held in such orientation while the screw fasteners are properly inserted through the aligned holes to secure the parts together. As can be readily appreciated, aligning the multiple parts of the receptacle assembly and then securing the parts together by the use of screw fasteners can be tedious and slow, and thus costly.

Consequently, a need still exists for improvements in the design and construction of an electrical receptacle assembly which reduces the above-mentioned drawbacks without introduction of others in their place.

SUMMARY OF THE INVENTION

The present invention provides an electrical receptacle assembly designed to satisfy the aforementioned, needs. The electrical receptacle assembly of the present invention employs fewer parts than the prior art electrical receptacle assembly. The electrical receptacle assembly has eliminated the need to use holes and screw fasteners to assemble these fewer parts thereby making their assembling much easier to accomplish in much less time. Also, the elimination of the use of screw fasteners and the employment of interference fitting and latching connections avoid the possibility of the assembled parts loosening up and exposing electrical connections within the receptacle.

Accordingly, the present invention is directed to an electrical receptacle assembly which comprises: (a) a housing having a front cover and a back cover, the back cover being separate from and mateable with the front cover; (b) a mounting bridge fitted over spaced portions of the mated front and back covers; and (c) a plurality of pairs of securement elements respectively defined on opposite wall portions of the front and back covers and on opposite portions of the mounting bridge being disposed adjacent to the opposite wall portions of the front and back covers, selected ones of the pairs of securement elements on the front and back covers being interference fittable and latchable with selected ones of the pairs of securement elements on the mounting bridge for releasably securing the mated front and back covers to the mounting bridge. The selected ones of the pairs of securement elements can be releasably coupled together and decoupled apart without the use of tools.

The securement elements defined on the respective opposite wall portions of the front cover are wedge-shaped ramps having respective front lips formed thereon so as to be spaced above the respective opposite wall portions. The securement elements defined on the respective opposite portions of the mounting bridge include flanges having respective ledges formed thereon so as to underlie and interfit with the respective front lips of the ramps. The securement elements defined on the respective opposite wall portions of the back cover are T-shaped projections. The securement elements defined on the respective opposite portions of the mounting bridge also include key-hole shaped openings having first portions for receiving the respective T-shaped projections therethrough and second portions being narrower in width than the first portions for slidably receiving and retaining the respective T-shaped projections in interfitting relation with and along the opposite portions of the mounting bridge.

These and other features and advantages and attainments of the present invention will become apparent to these skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
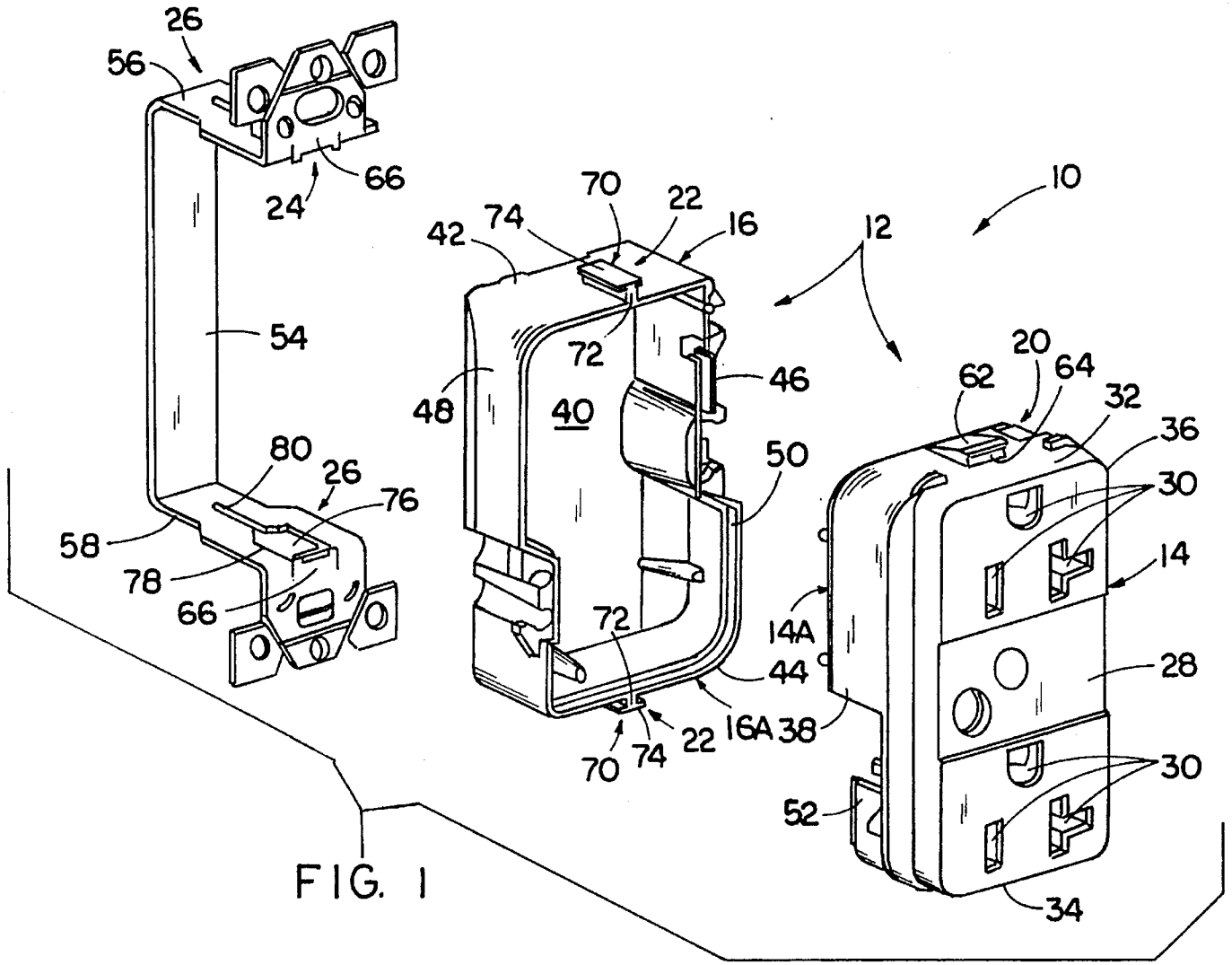
FIG. 1 is an exploded perspective view of an electrical receptacle assembly of the present invention employing interference fitting and latching type securements between its parts.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Figure 2:
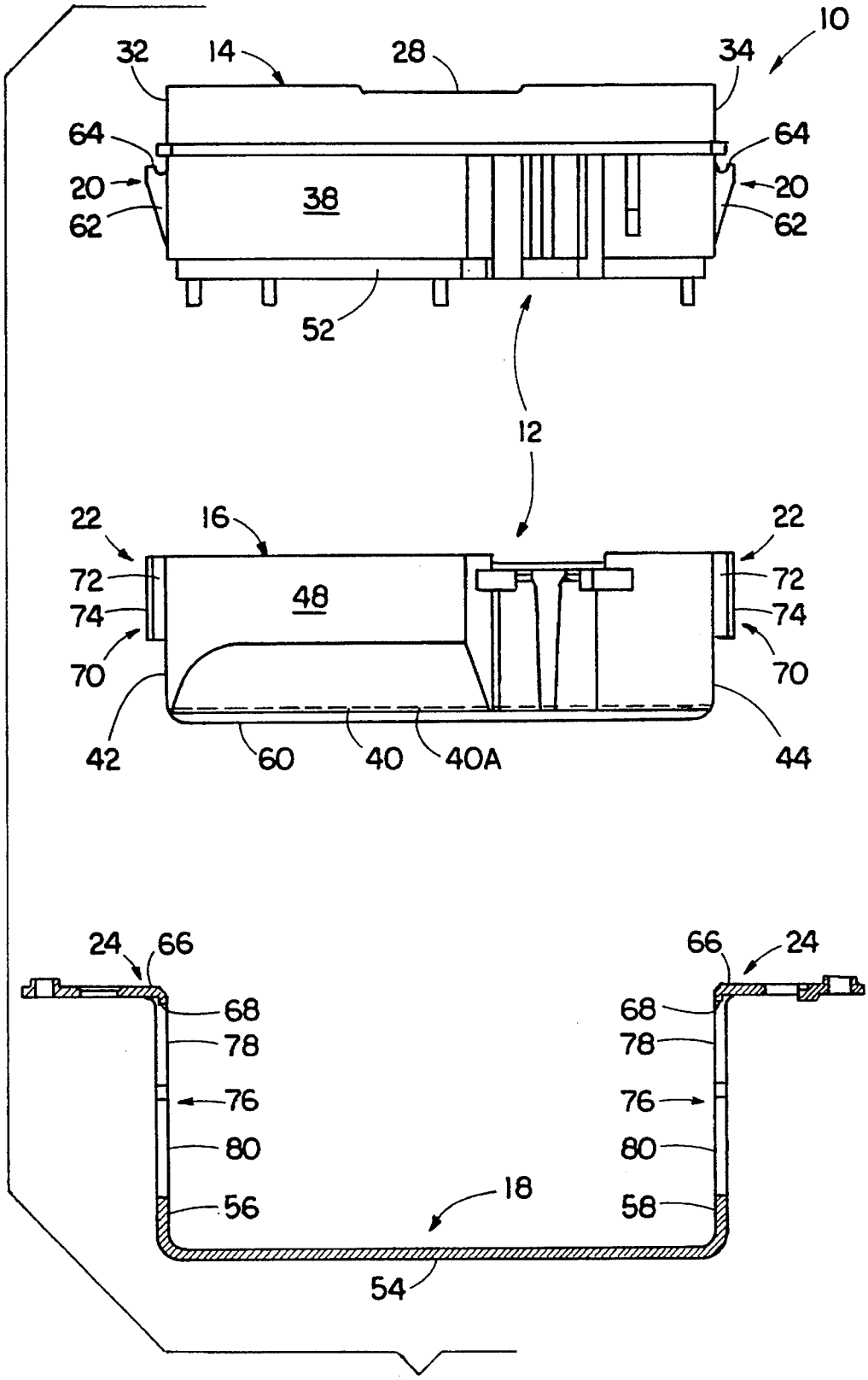
FIG. 2 is an enlarged exploded side elevational view of the electrical receptacle assembly.
Figure 3:
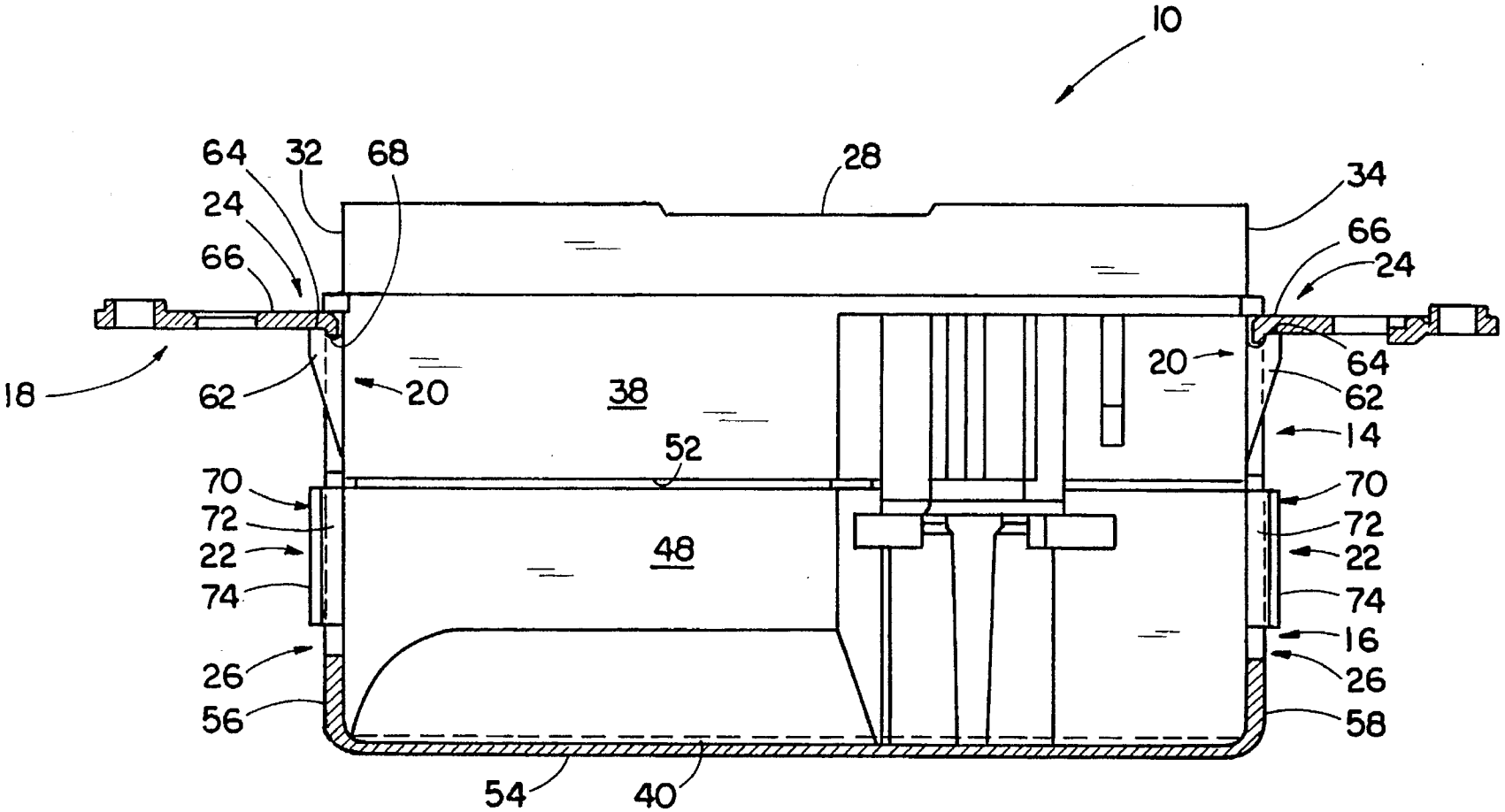
FIG. 3 is an enlarged assembled side elevational view of the electrical receptacle assembly.
Figure 5:
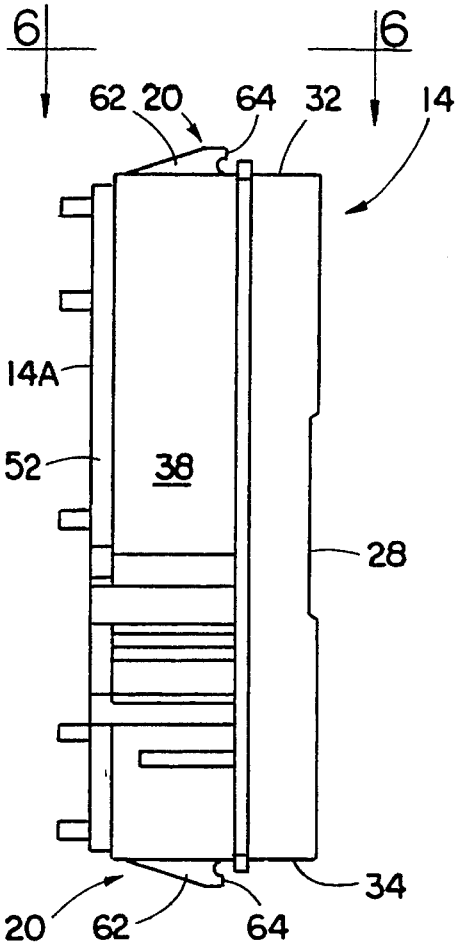
FIG. 5 is a side elevational view of the front cover of the housing as seen along line 5—5 of FIG. 4.
Figure 4:
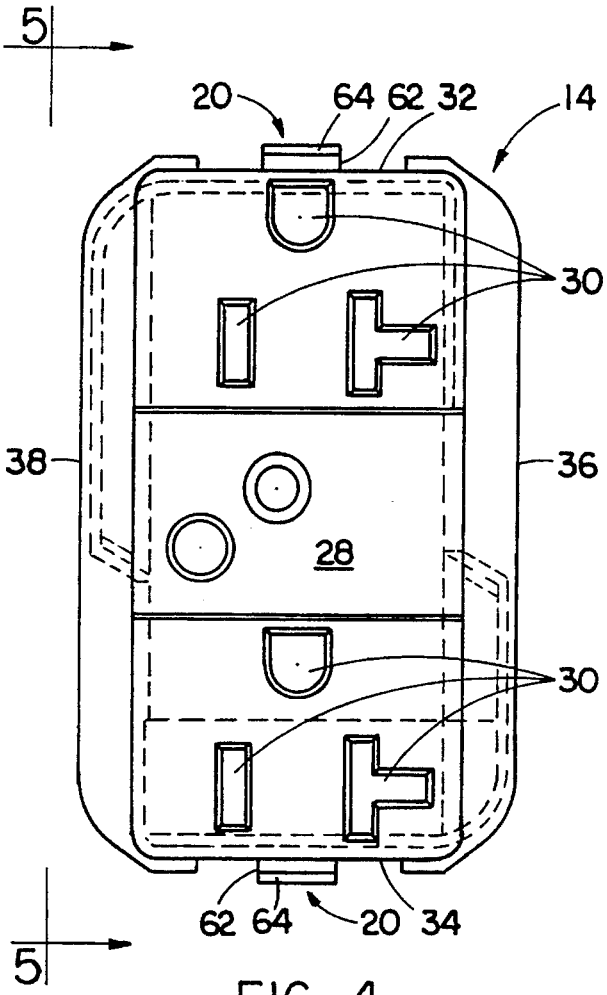
FIG. 4 is an enlarged front elevational view of a front cover of a housing of the receptacle assembly as seen along line 4—4 of FIG. 2.
Figure 6:
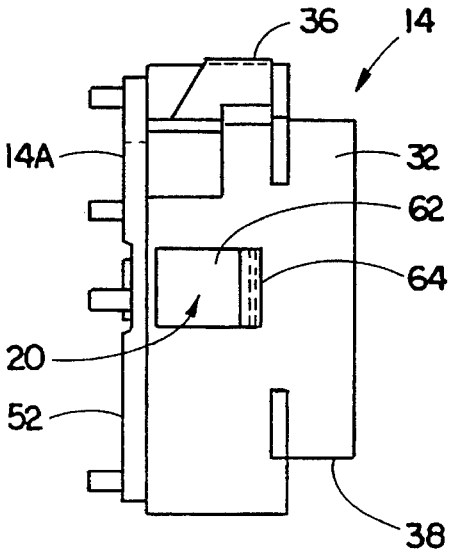
FIG. 6 is atop plan view of the front cover of the housing as seen along line 6—6 of FIG. 5.
Figure 8:
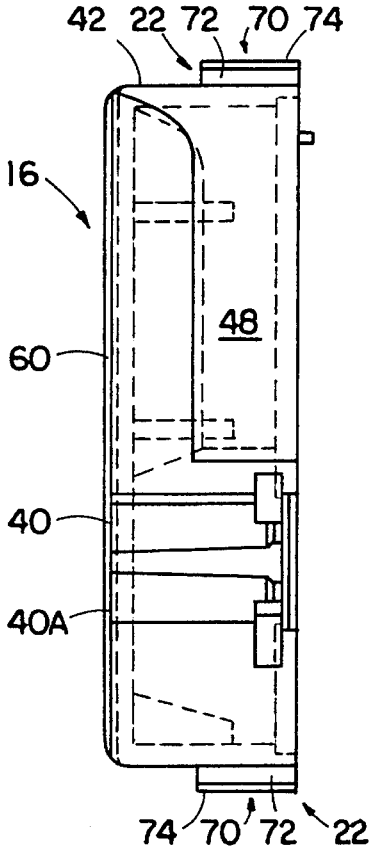
FIG. 8 is a side elevational view of the back cover of the housing as seen along line 8—8 of FIG. 7.
Figure 7:
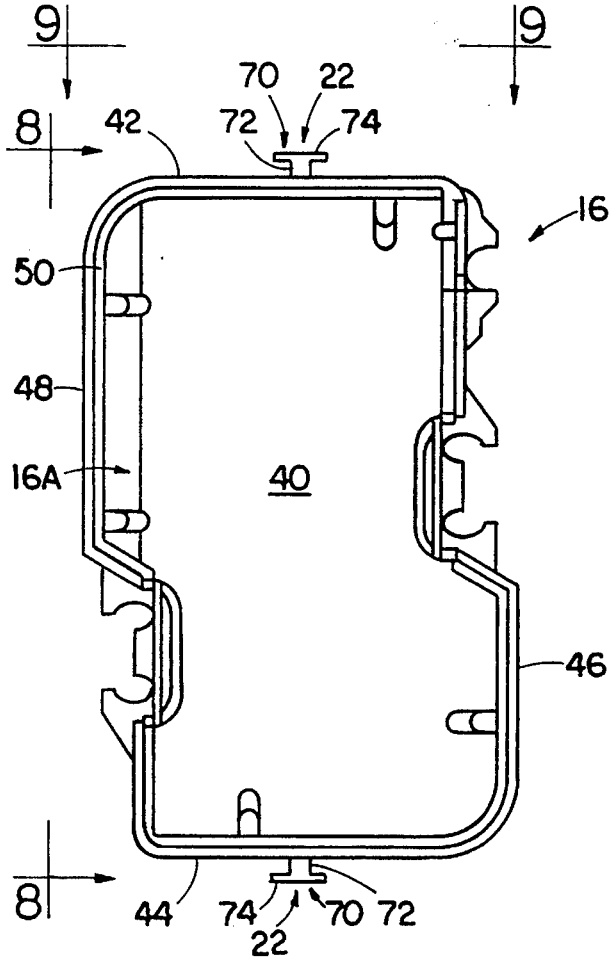
FIG. 7 is an enlarged front elevational view of a back cover of the housing of the receptacle assembly as seen along line 7—7 of FIG. 2.
Figure 9:
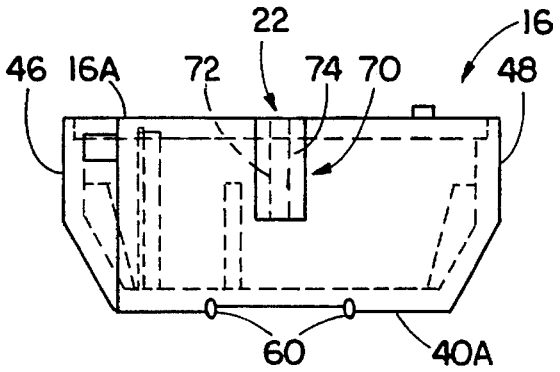
FIG. 9 is a top plan view of the back cover of the housing as seen along line 9—9 of FIG. 7.
Figure 11:
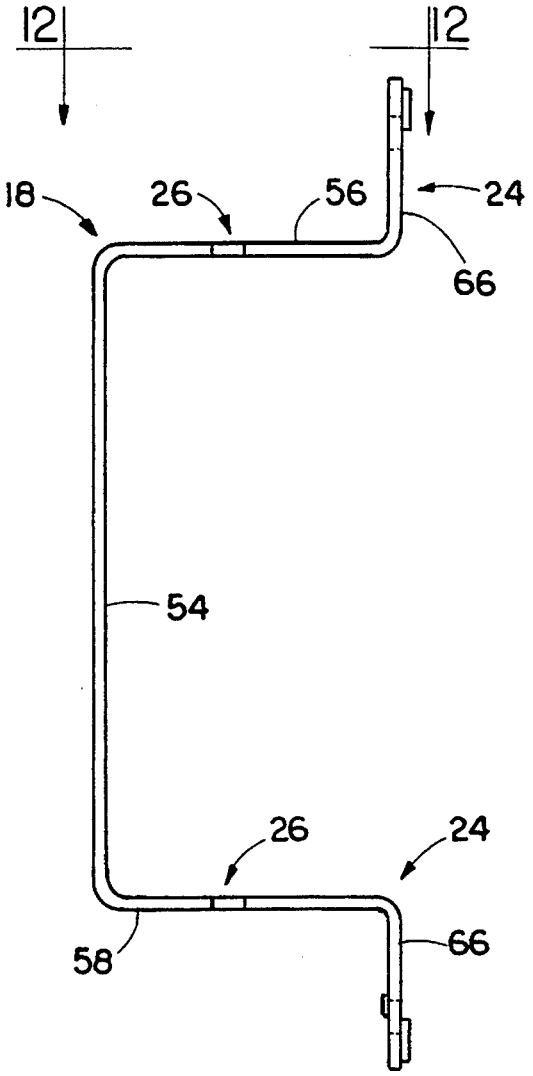
FIG. 11 is a side elevational view of the mounting bridge as seen along line 11—11 of FIG. 10.
Figure 10:
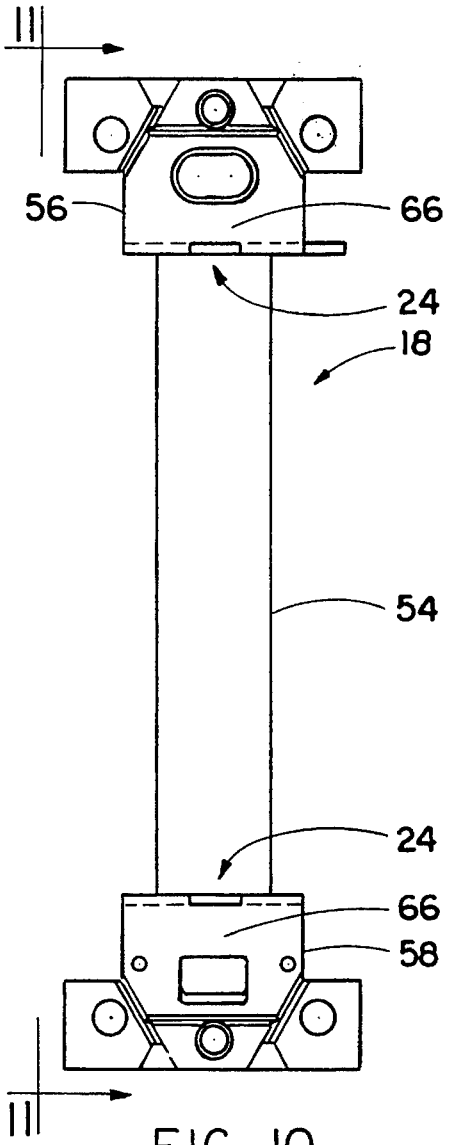
FIG. 10 is an enlarged front elevational view of a mounting bridge of the receptacle assembly as seen along 10—10 of FIG. 2.
Figure 12:
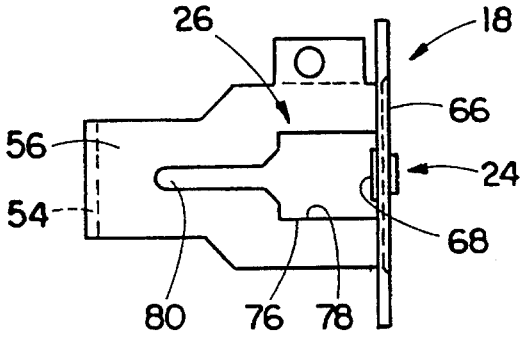
FIG. 12 is a top plan view of the mounting bridge as seen along line 12—12 of FIG. 11.

Referring now to the drawings, and particularly to FIGS. 1–3, there is illustrated an electrical receptacle assembly of the present invention, generally designated 10. The principles of the present invention employed by the electrical receptacle assembly 10 can be used in electrical receptacles for various applications. The application illustrated in the drawings is an electrical receptacle for a surge suppressor unit or the like.

Basically, the electrical receptacle assembly 10 includes a generally rectangular two-piece housing 12 having a front cover 14 and a back cover 16. The back cover 16 is separate from and mateable with the front cover 14. The assembly 10 also includes a generally U-shaped mounting bridge 18 which fits over spaced opposite portions of the mated front and back covers 14, 16 of the housing 12. The assembly 10 further includes a plurality of first, second, third and fourth pairs of securement elements 20, 22, 24 and 26.

More particularly, referring to FIGS. 1–6, the front cover 14 of the housing 12 includes a front wall 28 having varies plug slots 30 defined therethrough, a pair of top and bottom end walls 32, 34 attached to and extending rearwardly and outwardly from the front wall 28, and a pair of opposite side walls 36, 38 attached to and extending rearwardly and outwardly from the front wall 28 and extending between the top and bottom end walls 32, 34. Referring to FIGS. 1–3 and 7–9, the rear cover 16 of the housing 12 includes a solid rear wall 40, a pair of top and bottom end walls 42, 44 attached to and extending forwardly and outwardly from the rear wall 40, and a pair of opposite side walls 46, 48 attached to and extending forwardly and outwardly from the rear wall 40 and extending between the top and bottom end walls 42, 44. The back cover 16 has a narrow interior recess 50 formed in and extending along the front peripheral edges of the top and bottom end walls 42, 44 and of the side walls 46, 48 which define an open front end 16A in the back cover 16. The front cover 14 has a narrow exterior recess 52 formed in and extending along the rear peripheral edges of the top and bottom end walls 32, 34 and of the side walls 36, 38 which define an open rear end 14A in the front cover 14. Due to the presence of the respective recesses 50, 52, the back cover 16 at its front end 16A is mateable with and unmateable from the front cover 14 at its rear end 14A.

Referring to FIGS. 1–3 and 10–12, the mounting bridge 18 of the assembly 10 has a generally U-shaped configuration. The mounting bridge 18 includes a base portion 54 and a pair of opposite upper and lower leg portions 56, 58. The base portion 54 extends along an exterior surface 40A of the rear wall 40 of the back cover 16 and between a pair of laterally spaced ribs 60 formed on the exterior surface 40A of the rear wall 40 and extending between the top and bottom end walls 42, 44. The upper and lower leg portions 56, 58 are attached to and extend outwardly from opposite ends of the base portion 54 so as to overlie the respective top and bottom end walls 32, 34 and 42, 44 of the mated front and back covers 14, 16 of the housing 12.

Referring to FIGS. 1–12, the first and second pairs of securement elements 20, 22 are defined on the respective opposite top and bottom end walls 32, 34 and 42, 44 of the front and back covers 14, 16, while the third and four pairs of securement elements 24, 26 are defined on the opposite upper and lower leg portions 56, 58 of the mounting bridge 18. In the exemplary form shown in the drawings, the first securement elements 20 which are defined on the respective top and bottom end walls 32, 34 of the front cover 14 each takes the form of a wedge-shaped ramp 62 extending in inclined relation above and below the respective one of the top and bottom end walls 32, 34 and having a front lip 64 formed thereon protruding forwardly therefrom and being spaced above and below the respective one of the top and bottom end walls 32, 34. The wedge-shaped ramps 62 with the front lips 64 are substantially identical in configuration to one another. The third securement elements 24 which are defined on the opposite upper and lower leg portions 56, 58 of the mounting bridge 18 each takes the form of a flange 66 extending above and below the respective one of the upper and lower leg portions 56, 58 and having a ledge 68 formed thereon protruding rearwardly therefrom and spaced above and below the respective one of the upper and lower leg portions 56, 58 so as to underlie and interfit with the respective one of the front lips 64 of the ramps 62 when the front and back covers 14, 16 are mated with one another and located between the upper and lower leg portions 56, 58 of the mounting bridge 18.

Also in the exemplary form shown in the drawings, the second securement elements 22 which are defined on the respective top and bottom end walls 42, 44 of the back cover 16 each takes the form of a T-shaped projection 70 having a neck portion 72 attached to and extending outwardly from the respective one of the top and bottom end walls 42, 44 and a flat head portion 74 fixed on and extending transverse to the outer end of the neck portion 72. The T-shaped projections 70 are substantially identical in configuration to one another. The fourth securement elements 26 which are defined on upper and lower leg portions 56, 58 of the mounting bridge 18 each takes the form of a key-hole shaped opening 76 having first and second portions 78, 80 with the first portion 78 being larger in size than the second portion 80 of the opening 76. The first portion 78 of the opening 76 is also larger in length and width than the head portion 74 of the respective T-shaped projection 70 so as to receive the respective one of the T-shaped projections 70 therethrough. The second portions 80 of the opening 76 being narrower in width than the first portion 78 and the head portion 74 of the T-shaped projection 70 but wider in width than the neck portion 72 thereof is thereby adapted to slidably receive and retain the respective one of the T-shaped projections 70 in interfitting relation with and along the respective one of the upper and lower leg portions 54, 56 of the mounting bridge 18 when the back cover 16 is located between the upper and lower leg portions 56, 58.

The front and back covers 14, 16 are preferably fabricated as rigid structures molded from a suitable plastic, whereas the mounting bridge 18 is fabricated of a substantially rigid metal but the base portion 54 is sufficient resiliently springable to allow the upper and lower leg portions 56, 58 to be temporarily forced away from one another. To assemble the front and back covers 14, 16 to the mounting bridge 18, the upper and lower leg portions 56, 58 of the mounting bridge 18 are forced slightly away from one another so as to allow the back cover 16 to be fitted therebetween with the T-shaped projections 70 extending through the first portions 78 of the key-hole shaped openings 76 therein. The back cover 16 can then be slid rearwardly to bring its rear wall 40 into contact with the base portion 54 of the mounting bridge 18 and the T-shaped projections 70 into interfitted relationship with the narrow second portions 80 of the openings 76. Then, the upper and lower leg portions 56, 58 of the mounting bridge 18 are again forced slightly away from one another by forcing the front cover 14 between them with the ramps 62 thereon engaging the bottoms of the flanges 66 of the third securement elements 24. Once the front lips 64 on the ramps 62 have moved rearwardly past the ledges 68 on the flanges 66, a snap-fitted or latched connected is thereby secured between the front cover 14 and the upper and lower leg portions 56, 58 of the mounting bridge 18. By again forcing apart from one another the upper and lower leg portions 56, 58 of the mounting bridge 18, the front and rear covers 14, 16 can be uncoupled from the mounting bridge 18.

For the foregoing description of the securement elements 20, 22, 24, 26, it can be readily understood that selected ones of the first, second, third and fourth pairs of securement elements 20, 22, 24, 26 are interference fittable and latchable with one another for securing the mated front and back covers 14, 16 of the housing 12 to the mounting bridge 18. Furthermore, the pairs of securement elements 20, 22, 24, 26 can be releasably coupled together and decoupled apart without the use of any tools.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

We claim:

1. An electrical receptacle assembly, comprising:

(a) a housing having a front cover and a back cover, said back cover being separate from and mateable with said front cover;

(b) a mounting bridge fitted behind said back cover and over spaced portions of said mated front and back covers; and (c) a plurality of pairs of securement elements defined on respective opposite wall portions of said front and back covers and on respective opposite portions of said mounting bridge being disposed adjacent to said opposite wall portions of said front and back covers, said pair of securement elements on said back cover being interference fittable with one pair of said securement elements on said mounting bridge, and said pair of securement elements on said front cover being latchable with another pair of said securement elements on said mounting bridge, for releasably securing said mated front and back covers to said mounting bridge.

2. The assembly as recited in claim 1, wherein said front cover includes a front wall, a pair of top and bottom end walls attached to and extending outwardly from said front wall, and a pair of opposite side walls attached to and extending outwardly from said front wall and between said top and bottom walls.

3. The assembly as recited in claim 2, wherein said securement elements are defined on said top and bottom end walls of said front cover.

4. The assembly as recited in claim 1, wherein said securement elements defined on said opposite wall portions of said front cover are wedge-shaped ramps having respective front lips formed thereon so as to be spaced above said opposite wall portions.

5. The assembly as recited in claim 4, wherein said securement elements defined on said opposite portions of said mounting bridge include flanges having respective ledges formed thereon so as to underlie and interfit with said respective front lips of said ramps.

6. The assembly as recited in claim 1, wherein said rear cover includes a rear wall, a pair of top and bottom end walls attached to and extending outwardly from said front wall, and a pair of opposite side walls attached to and extending outwardly from said front wall and between said top and bottom walls.

7. The assembly as recited in claim 6, wherein said securement elements are defined on said top and bottom end walls of said back cover.

8. The assembly as recited in claim 1, wherein said securement elements defined on said opposite wall portions of said back cover are T-shaped projections.

9. The assembly as recited in claim 8, wherein said securement elements defined on said opposite portions of said mounting bridge include key-hole shaped openings having first portions for receiving said respective T-shaped projections therethrough and second portions being narrower in width than said first portions for slidably receiving and retaining said respective T-shaped projections in interfitting relation with and along said opposite portions of said mounting bridge.

10. The assembly as recited in claim 1, wherein said mounting bridge has a generally U-shaped configuration.

11. The assembly as recited in claim 10, wherein said mounting bridge includes a base portion for extending along a rear wall portion of said back cover and a pair of opposing leg portions attached to and extending outwardly from opposite ends of said base portion so as to overlie said opposite portions of said front and back covers of said housing.

12. The assembly as recited in claim 1, wherein said securement elements defined on said opposite portions of said front cover are substantially identical to one another.

13. The assembly as recited in claim 1, wherein said securement elements defined on said opposite portions of said back cover are substantially identical to one another.

14. The assembly as recited in claim 1, wherein said securement elements defined on said opposite portions of said mounting bridge are substantially identical to one another.

15. The assembly as recited in claim 1, wherein said securement elements on said front and back covers being releasably couplable with and decouplable from said securement elements on said mounting bridge without the use of tools.

16. An electrical receptacle assembly, comprising:

(a) a generally rectangular two-piece housing having a front cover and a back cover, said back cover being separate from said front cover and being mateable at a front end with a rear end of said front cover;

(b) a generally U-shaped mounting bridge fitted behind said back cover and over opposite top and bottom portions of said mated front and back covers; and (c) a plurality of pairs of securement elements respectively defined on said top and bottom portions of said front and back covers and on top and bottom portions of said mounting bridge, said pair of securement elements on said back cover being interference fittable with one pair of said securement elements on said mounting bridge, and said pair of securement elements on said front cover being latchable with another pair of said securement elements on said mounting bridge, for releasably securing said mated front and back covers to said mounting bridge, said pairs of securement elements on said front and back covers also being releasably couplable with and decouplable from said securement elements on said mounting bridge without the use of tools.

17. The assembly as recited in claim 16, wherein:

said securement elements defined on said opposite top and bottom portions of said front cover are wedgeshaped ramps having respective front lips formed thereon so as to be spaced above said opposite top and bottom portions; and said securement elements defined on said opposite top and bottom portions of said mounting bridge are flanges having respective ledges formed thereon so as to underlie said respective front lips of said ramps.

18. The assembly as recited in claim 16, wherein:

said securement elements defined on said opposite top and bottom portions of said back cover are T-shaped projections; and said securement elements defined on said opposite portions of said mounting bridge are key-hole shaped openings having first portions for receiving said respective T-shaped projections therethrough and second portions being narrower in width than said first portions for slidably receiving and retaining said respective T-shaped projections in interfitting relation with and along said opposite portions of said mounting bridge.

19. The assembly as recited in claim 16, wherein said mounting bridge has a generally U-shaped configuration.

20. The assembly as recited in claim 16, wherein said mounting bridge includes a base portion for extending along a rear wall portion of said back cover and a pair of opposing leg portions attached to and extending outwardly from opposite ends of said base portion so as to constitute said opposite top and bottom portions of said bridge overlying said opposite top and bottom portions of said front and back covers of said housing.

* * * * *